US010022005B2

(12) United States Patent
Carpinelli

(10) Patent No.: US 10,022,005 B2
(45) Date of Patent: Jul. 17, 2018

(54) HANGER DEVICE BY DECORACK

(71) Applicant: Scott Anthony Carpinelli, Arlington Heights, IL (US)

(72) Inventor: Scott Anthony Carpinelli, Arlington Heights, IL (US)

(73) Assignee: Scott Anthony Carpinelli, Arlington Heights, IL (US)

( * ) Notice: Subject to any disclaimer, the term of this patent is extended or adjusted under 35 U.S.C. 154(b) by 54 days.

(21) Appl. No.: 14/536,591

(22) Filed: Nov. 8, 2014

(65) Prior Publication Data

US 2016/0007741 A1 Jan. 14, 2016

Related U.S. Application Data

(60) Provisional application No. 61/911,844, filed on Dec. 4, 2013.

(51) Int. Cl.

| | |
|---|---|
| ***A47B 61/02*** | (2006.01) |
| ***G09F 23/00*** | (2006.01) |
| ***A47G 25/06*** | (2006.01) |

(52) U.S. Cl.

CPC ..... *A47G 25/0685* (2013.01); *A47B 61/02* (2013.01); *G09F 23/00* (2013.01)

(58) Field of Classification Search

CPC ..... A47G 25/0685; G09F 23/00; G09F 7/20; G09F 7/22; G09F 2007/1891; G09B 1/04; G09B 1/06; G09B 1/16; G09B 1/30; G09B 1/40; A47B 61/003; A47B 61/02

USPC ..... 40/497, 530, 531, 532, 533, 534, 535, 40/536, 537, 596, 605, 606.07, 606.15, 40/606.16, 611.04, 611.02, 611.03, 733, 40/606.11, 552; 211/85.3, 96, 97, 168, 211/110; 223/89, 94, 88; D6/558, 557, D6/556, 564, 565, 548, 549; 248/303, 248/304

See application file for complete search history.

(56) References Cited

U.S. PATENT DOCUMENTS

| | | | | | |
|---|---|---|---|---|---|
| 36,666 | A | * | 10/1862 | Montignani | A47G 25/0685 211/96 |
| 38,631 | A | * | 5/1863 | Patton | A47G 25/0685 211/96 |
| 40,173 | A | * | 10/1863 | Lambert | A47G 25/0685 211/96 |
| 43,069 | A | * | 6/1864 | Buell | A47G 25/0685 211/96 |
| 143,228 | A | * | 9/1873 | Doyle et al. | A47B 5/04 211/96 |
| 203,241 | A | * | 5/1878 | Bovey | A47G 25/0685 211/96 |

(Continued)

FOREIGN PATENT DOCUMENTS

| | | | | | |
|---|---|---|---|---|---|
| GB | 215639 | A | * | 5/1924 | G09F 7/22 |
| GB | 286455 | A | * | 3/1928 | A47B 61/003 |

(Continued)

*Primary Examiner* — Stanton L Krycinski

(57) ABSTRACT

A hanger device (10) for hanging items of apparel thereon has a base (12) and an indicia member (14). The base (12) is configured to be mounted on a surface (2) of a door (1). The indicia member (14) is pivotally connected to the base (12). The indicia member (12) is pivotable from a first position wherein the indicia of the member (14) is displayed, to a second position wherein items of apparel are capable of being hung on the indicia member (14).

10 Claims, 12 Drawing Sheets

(56) References Cited

U.S. PATENT DOCUMENTS 207,132 A * 8/1878 Reed ..... A47G 25/0685 211/96
368,036 A * 8/1887 Westfall ..... A47G 25/0685 211/96
400,539 A * 4/1889 Beller ..... G09F 13/16 40/596
416,685 A * 12/1889 Nichols ..... A47G 25/0685 211/96
458,590 A * 9/1891 Matthies ..... A47G 25/1407 248/304
684,461 A * 10/1901 Richards ..... A47G 25/0685 211/106
823,807 A * 6/1906 Peters ..... A47G 25/0685 211/96
914,697 A * 3/1909 Bryant ..... A47G 7/045 16/223
1,208,986 A * 12/1916 Krodel ..... F16M 13/02 16/223
1,235,443 A * 7/1917 Cotton ..... A47G 25/0685 211/180
1,244,314 A * 10/1917 Frutchey ..... A47G 25/0685 211/96
1,246,884 A * 11/1917 Comins ..... A47G 25/0685 211/96
1,362,465 A * 12/1920 Bearicks ..... G09F 7/20 40/617
1,403,669 A * 1/1922 Chouinard ..... G03B 15/08 352/55
1,934,430 A * 11/1933 Komer ..... A47G 25/743 211/118
2,028,665 A * 1/1936 Henry ..... A47H 5/09 211/96
2,028,666 A * 1/1936 Henry ..... A47H 5/09 211/96
2,028,667 A * 1/1936 Henry ..... A47H 5/09 211/96
2,075,279 A * 3/1937 Good ..... A47J 47/16 211/106
2,095,384 A * 10/1937 Gleitsman ..... B65D 25/282 211/168
2,168,361 A * 8/1939 Olson ..... A47G 25/0685 211/1.3
2,388,366 A * 11/1945 Peterson ..... A47K 10/04 211/105.2
2,399,029 A * 4/1946 Hoag ..... G09F 7/10 40/623
2,473,029 A * 6/1949 Kovacs ..... A47G 25/746 211/106
2,501,044 A * 3/1950 Gianelloni, Jr. ..... G09F 7/22 40/533
2,572,665 A * 10/1951 Rochow ..... A47G 25/0685 211/104
2,595,521 A * 5/1952 Hanson ..... D06F 57/12 16/223
2,901,116 A * 8/1959 Daley ..... A47G 25/746 211/85.3
2,987,193 A * 6/1961 Pajor ..... A47G 25/0685 211/89.01
3,059,363 A * 10/1962 Mack ..... G09F 7/08 40/618
3,200,435 A * 8/1965 Hemmeter ..... A47G 25/0685 16/223
3,429,546 A * 2/1969 Porter ..... G09F 7/20 211/104
3,455,044 A * 7/1969 Falconbridge ..... G09F 7/22 40/529
3,734,054 A * 5/1973 Anderson ..... G10K 3/00 116/148
3,825,127 A * 7/1974 Morrison ..... A47G 25/0685 16/223
D251,944 S * 5/1979 Chasen ..... D6/556
4,155,185 A * 5/1979 Lemelson ..... G09F 7/02 40/596
4,327,837 A * 5/1982 Ross ..... A47G 25/746 211/85.3
4,901,866 A 2/1990 Barella
5,143,231 A * 9/1992 Chang ..... A47B 61/003 211/168
D348,632 S * 7/1994 Hollinger ..... D30/124
D371,507 S * 7/1996 Hollinger ..... D11/148
5,933,991 A * 8/1999 Gaul ..... G09F 7/22 15/250.21
5,967,344 A 10/1999 Liberati
D424,412 S 5/2000 Laughton
6,073,335 A * 6/2000 Lampers ..... E06B 7/30 248/301
6,152,313 A 11/2000 Klein et al.
D438,714 S * 3/2001 Osborne ..... D6/316
D446,658 S 8/2001 Osborne
6,303,195 B1 * 10/2001 Reynolds ..... A47B 96/061 248/207
6,588,607 B2 * 7/2003 Smith ..... A47F 5/05 211/96
D503,854 S * 4/2005 Hess ..... D6/326
6,991,204 B2 1/2006 Ay
7,121,418 B2 10/2006 Stier
D553,966 S * 10/2007 Triay ..... D8/363
D561,571 S * 2/2008 Houghland ..... D8/381
7,578,255 B2 * 8/2009 Pittenger ..... E06B 7/30 116/148
7,793,450 B2 9/2010 Chasmer et al.
7,908,711 B2 3/2011 Johnson
8,375,614 B2 * 2/2013 Stephenson ..... G09F 7/22 40/606.15
8,534,513 B1 * 9/2013 Dixon ..... A47G 25/1407 223/88
8,540,087 B1 * 9/2013 Skaer ..... A47G 25/0685 211/100
8,631,979 B1 * 1/2014 Reahard ..... A47G 25/743 211/118
2006/0006301 A1 * 1/2006 Turi ..... G09F 23/00 248/304
2006/0049323 A1 3/2006 Anzai
2006/0091093 A1 5/2006 Armari
2008/0083091 A1 * 4/2008 Palairet ..... A47G 25/06 16/404
2010/0108834 A1 * 5/2010 Rigas ..... A47G 25/0685 248/213.1
2012/0017478 A1 * 1/2012 Stephenson ..... G09F 7/22 40/606.18

FOREIGN PATENT DOCUMENTS

GB 323867 A * 1/1930 ..... A47G 25/0685
GB 2265823 A * 10/1993 ..... A47G 25/065
JP WO 2012111371 A1 * 8/2012 ..... A47G 25/1407

* cited by examiner

HANGER DEVICE BY DECORACK

CROSS-REFERENCE TO RELATED APPLICATIONS

The present application claims the benefit of U.S. Provisional Patent Application No. 61/911,844, filed on Dec. 4, 2013, which is hereby incorporated by reference herein and made a part hereof.

FEDERALLY SPONSORED RESEARCH OR DEVELOPMENT

None.

TECHNICAL FIELD

The invention relates generally to a hanger device and more particularly, to a hanger device having an indicia member wherein the indicia member is pivotably mounted and is capable of functioning as a display and also as defining a projection for hanging of apparel thereon.

BACKGROUND OF THE INVENTION

Hanger devices are well-known in the art and come in a variety of different forms. One particular type of hanger device is used for hanging items of apparel thereon. Certain of these hanger devices may be referred to as coat racks and may be self-supporting or designed to be mounted on surface such as a wall. Oftentimes, hanger device designs are bulky and cumbersome.

While such hanger devices, according to the prior art, provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a hanger device for hanging items thereon such as items of apparel. It is understood that other types of items can be hung from the device. The device has multiple mounting configurations. An indicia member associated with the device can be interchanged to provide various different indicia to be displayed.

In one exemplary embodiment, the hanger device has a base and an indicia member. The base is configured to be mounted on a mounting surface, such as a surface of a door. The indicia member is pivotally connected to the base. The indicia member is pivotable from a first position wherein the indicia of the member is displayed, to a second position wherein items of apparel are capable of being hung on the indicia member.

According to another aspect of the invention, the base has a hinge member wherein the indicia member is connected to the hinge member, the indicia member being pivotable by the hinge member.

According to a further aspect of the invention, the indicia member defines at least one projection wherein the item of apparel is capable of being hung from the projection.

According to another aspect of the invention, the base has a first hinge member and the indicia member has a first indicia segment connected to the first hinge member. The first indicia segment is pivotable by the first hinge member from a first position to a second position. When the first indicia segment is in the first position, the indicia is displayed. When the first indicia segment is in the second position, items of apparel are capable of being hung on the first indicia segment. The base also has a second hinge member and the indicia member has a second indicia segment connected to the second hinge member. The second indicia segment is pivotable by the second hinge member from a first position to a second position. When the second indicia segment is in the first position, the indicia is displayed. When the second indicia segment is in the second position, items of apparel are capable of being hung on the second indicia segment.

According to a further aspect of the invention, the first indicia segment and the second indicia segment define a plurality of projections wherein items of apparel are capable of being hung from the projections.

According to another aspect of the invention, the indicia member is generally coplanar with the base in the first position, and wherein the indicia member is not coplanar with the base in the second position. In addition, the indicia member is pivoted away from the base in the second position.

According to another aspect of the invention, the indicia member has a first indicia segment and a second indicia segment, wherein the first indicia segment and the second indicia segment collectively define the indicia. In a further aspect, respective distal ends of the first indicia segment and the second indicia segment confront one another when the indicia member is in the first position to display the indicia. The first indicia segment comprises a first set of letters and the second indicia segment comprises a second set of letters, wherein when the first indicia segment is positioned generally adjacent to the second indicia segment in the first position wherein the respective sets of letters collectively define the indicia in the form of a word. In one exemplary embodiment, the word is "Welcome." The indicia member may also comprise a plurality of indicia segments wherein when the respective indicia segments are in the first position, the portions collectively define the indicia in the form of a phrase. The phrase may comprise a plurality of words.

According to a further aspect of the invention, the base has a first member having at least one mounting aperture. The base is configured to be mounted on a surface of the door in one of a first configuration and a second configuration. In the first configuration, the mounting aperture receives a fastener. In the second configuration, the mounting aperture is dimensioned such that the mounting aperture is configured to be positioned around and supported by a door-viewer structure of the door. In addition, the base has a first member having a first plurality of mounting apertures, and wherein the base has a second member having a second plurality of mounting apertures.

According to another aspect of the invention, the base has a hinge member and the indicia member is connected to the hinge member. The hinge member is rotatable about a generally vertical axis, wherein the indicia member is rotated away from the base in the second position. In addition, the hinge member has a rod connected to the base and a cylinder rotatable about the rod, wherein the cylinder is connected to the indicia member.

According to another aspect of the invention, the base has a first member and a second member, the base members defining at least one mounting aperture. The base further has a first hinge member and a second hinge member positioned between the first member and the second member. The hinge members are rotatable about generally vertical axes. The indicia member has a first indicia segment connected to the first hinge member and a second indicia segment connected to the second hinge member. The first indicia segment and second indicia segment define projections, wherein the first indicia segment is pivotable by the first hinge member from the first position to the second position, and wherein the second indicia segment is pivotable by the second hinge member from the first position to the second position. When the indicia members are in the first position, the first indicia segment and the second indicia segment collectively define the indicia that is displayed from the device, wherein when the indicia segments are in the second position, items of apparel are capable of being hung on the projections.

According to another aspect of the invention, the base has a plurality of hinge members and the indicia member has a plurality of indicia segments. Each indicia segment is connected to a respective hinge member. In a first position, the indicia segments collectively define and display the indicia. In a second position, the indicia segments define projections wherein items of apparel are capable of being hung on the projections.

According to a further aspect of the invention, indicia member is removably connected to the base wherein a second indicia member is configured to be pivotally connected to the base to display a second indicia different from indicia associated with the indicia member.

According to a further aspect of the invention, a kit may be provided having a base and a plurality of indicia members having different indicia. Connecting structures may also be included with the base wherein the base can removably support one of the plurality of indicia members. The base can support a first indicia member that displays a first indicia and then a second indicia member can replace the first indicia member wherein the second indicia member displays a second indicia that is different from the first indicia.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
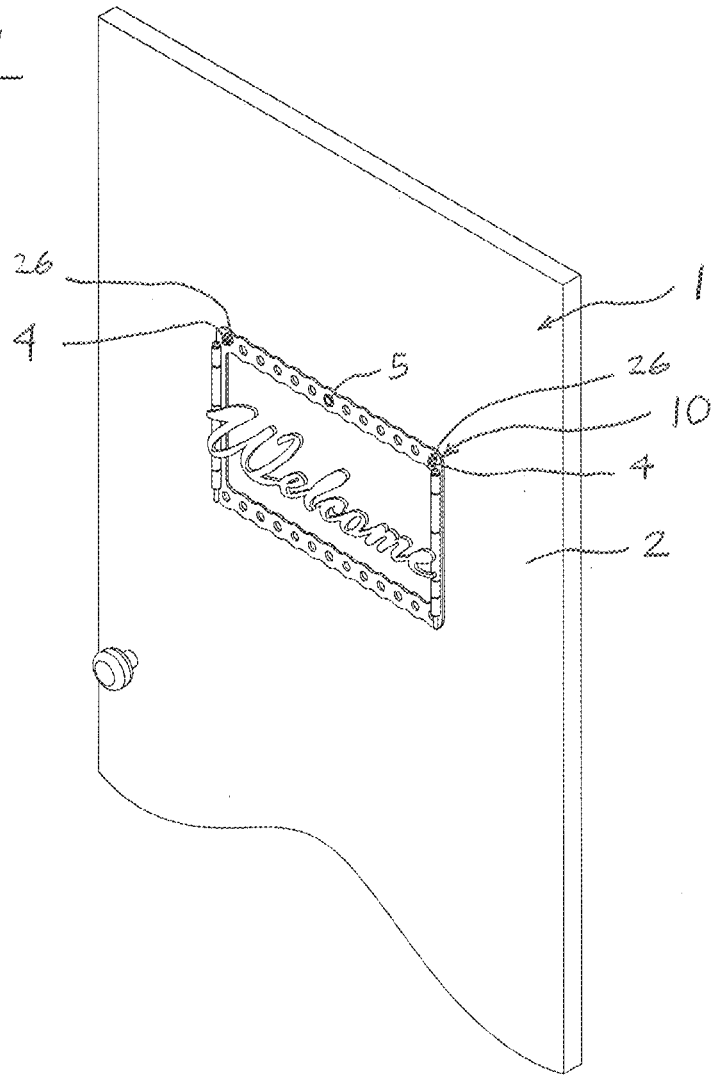
FIG. 1 is a perspective view of a hanger device according to the present invention mounted on a surface of a door.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 discloses a hanger device according to the present invention generally designated by the reference numeral 10. The hanger device 10 is designed to be mounted to a surface 2 of a door 1 in one exemplary embodiment. As described in greater detail below, the mounting surface can take various different forms.

FIGS. 2-13 show additional views of the hanger device 10. As shown in FIGS. 2-13, the hanger device 10 generally includes a base 12 and an indicia member 14. FIGS. 1-13 disclose one exemplary embodiment of the indicia member 14 and additional exemplary embodiments of the indicia member 14 will be described in greater detail below.

FIGS. 2-6 generally further show the base 12. The base 12 is generally a rectangular member although other shapes are possible. The base 12 has a first upper member 16 and a second lower member 18. The upper member 16 and lower member 18 are connected by a first vertical side member 20 and a second vertical side member 22. The upper and lower members 16,18 and side members 20,22 collectively define a periphery of the hanger device 10 as well as collectively reside generally in a plane.

The upper member 16 has a plurality of mounting apertures 24. The mounting apertures 24 are generally horizontally aligned providing multiple locations for mounting. The mounting apertures 24 include an end aperture 26 at each end of the upper member 16. The end apertures 26 have a notch 28 therein. In such configuration, a head of a mounting nail fastener or screw fastener can fit through the end aperture 26 and shaft member of the nail or screw can fit into the notch 28. The mounting apertures 24 further include a central mounting aperture 30 located generally at a center or middle of the upper member 16, e.g., centrally-located. The central mounting aperture 30 is dimensioned to fit around and be operably connected to a door-viewer structure of a door to be described in greater detail below. It is understood that the lower member 18 has similar mounting apertures 24, end apertures 26 and central mounting aperture 30. It is also understood that the upper member 16 and lower member 18 could be constructed such that only the end apertures 26 and central mounting aperture 30 are included wherein adjacent portions of the members 16,18 could be solid and uninterrupted, planar, or some other configuration not utilizing a series of apertures. Such solid portions could be further used for displaying additional indicia.

Figure 2:
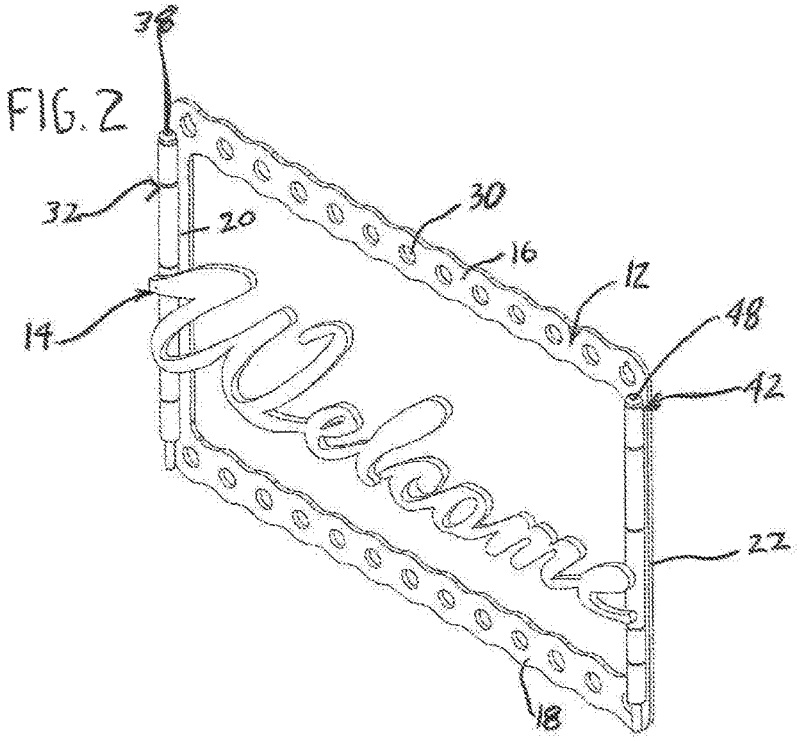
FIG. 2 is a perspective view of the hanger device shown in FIG. 1.
Figure 3:
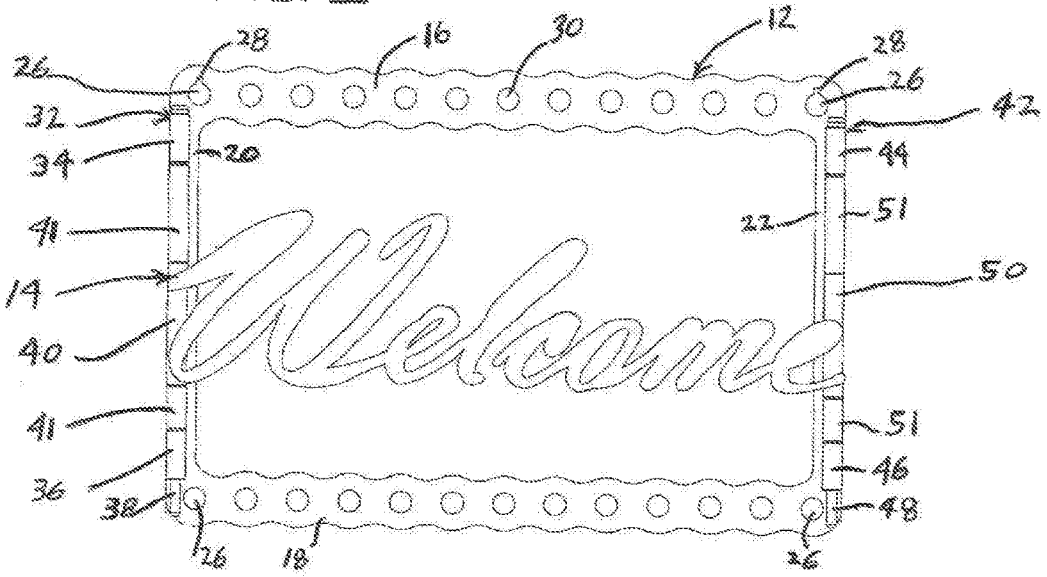
FIG. 3 is a front elevation view of the hanger device shown in FIG. 1.
Figure 4:
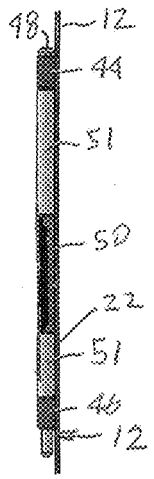
FIG. 4 is a side elevation view of the hanger device shown in FIG. 1.
Figure 6:
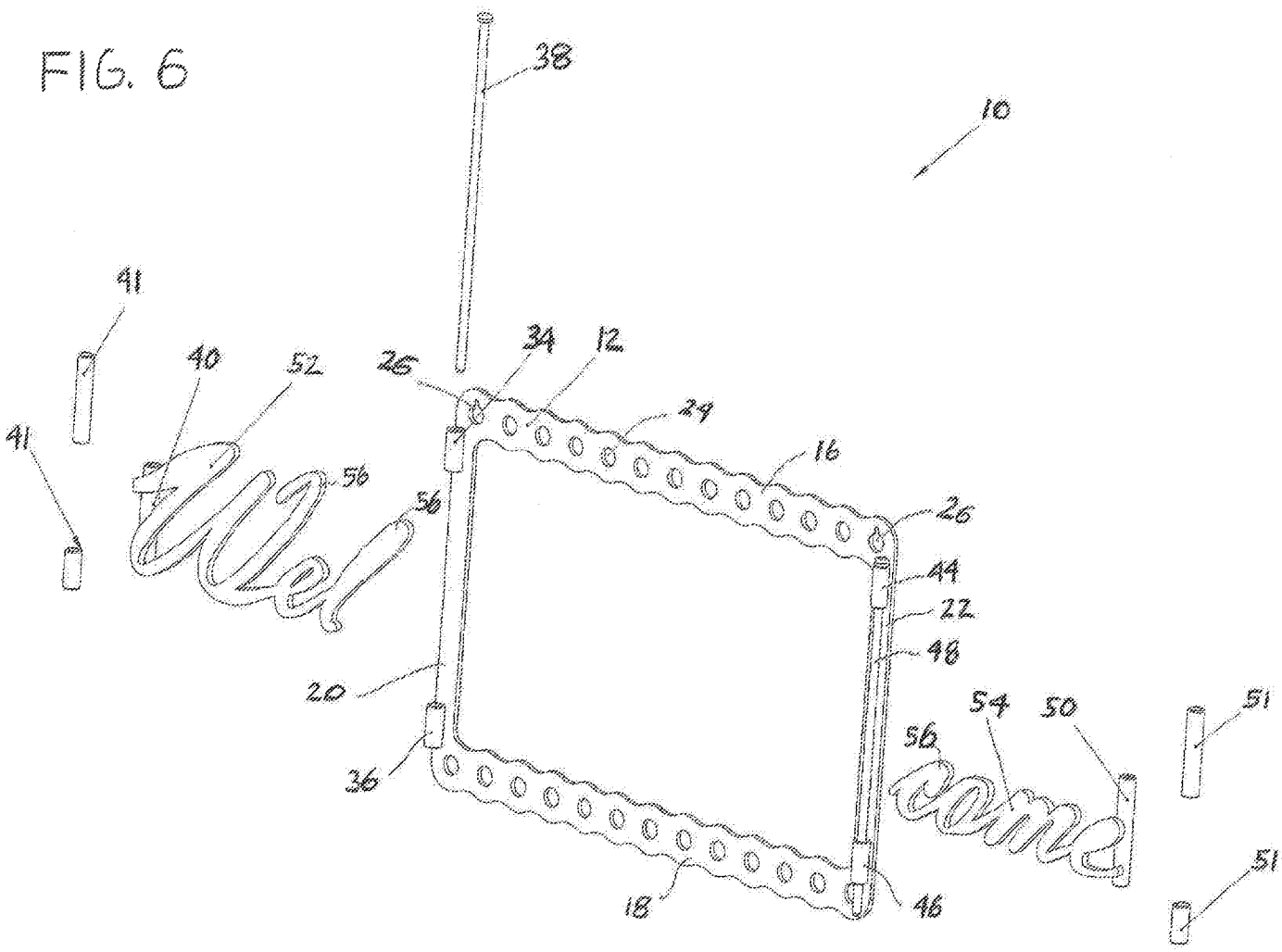
FIG. 6 is an exploded view of the hanger device shown in FIG. 1.

As further shown in FIGS. 2, 3 and 6, the first vertical side member 20 supports a first hinge member 32. The first hinge member 32 is operably connected between the first side member 20 and the indicia member 14 to be described in greater detail below. The hinge member 32 includes a first support 34 and a second support 36. The hinge member 34 further includes a rod 38 and a cylinder 40. The cylinder 40 has an opening that receives the rod 38 and the rod 38 is supported at each of its ends by the first support 34 and the second support 36. The supports 34,36 as well as opposing supports to be described may also be considered as bushings. The cylinder 40 is rotatable about the rod 38. The hinge 32 may also utilize a pair of spacers 41. In this exemplary embodiment, the spacers 41 are positioned above and below the cylinder 40. It is understood that the length of the cylinders 41 can vary as desired which will adjust the indicia member 14 within the periphery of the base 12. These components are further shown in the exploded view of FIG. 6. Similarly, the second vertical side member 22 supports a second hinge member 42. The second hinge member 42 is operably connected between the second side member 22 and the indicia member 14 to be described in greater detail below. The second hinge member 42 includes a first support 44 and a second support 46. The second hinge member 42 further includes a rod 48 and a cylinder 50. The cylinder 50 has an opening that receives the rod 48 and the rod 48 is supported at each of its ends by the first support 44 and the second support 46. The cylinder 50 is rotatable about the rod 48. The second hinge member 42 may also utilize a pair of spacers 51. The length of the spacers 51 can vary as discussed.

Figure 7:
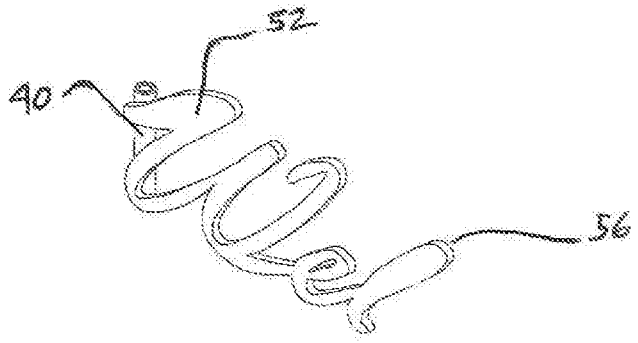
FIG. 7 is a perspective view of a first indicia segment of the hanger device shown in FIG. 1.
Figure 8:
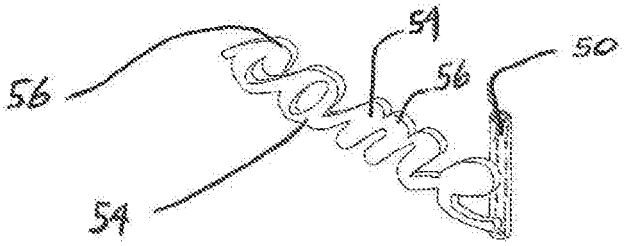
FIG. 8 is a perspective view of a second indicia segment of the hanger device shown in FIG. 1.

FIGS. 2-8 further show the indicia member 14. The indicia member 14 displays indicia which can take various different forms. In one exemplary embodiment, the indicia displayed is the word "Welcome." The indicia member 14 could be a single member that is operably connected to a single hinge member. In one exemplary embodiment, however, the indicia member 14 has a plurality of indicia members and, in particular, the indicia member 14 has a first indicia segment 52 and a second indicia segment 54. The indicia member 14 is operably connected to the base 12 via the hinge 32,42. In particular, the first indicia segment 52 is connected to the first hinge 32 and the second indicia segment 54 is connected to the second hinge 42. As shown in FIG. 7, the first indicia segment 52 comprises the first three letters of the indicia, namely the letters "Wel." As shown in FIG. 8, the second indicia segment 54 comprises the last four letters of the indicia, namely the letters "come." The first indicia segment 52 is connected to the cylinder 40 of the first hinge member 32. In one exemplary embodiment, the first indicia segment 52 may be considered to be integral with the cylinder 40 of the first hinge member 32 (FIG. 7). Similarly, the second indicia segment 54 is connected to the cylinder 50 of the second hinge member 54 (FIG. 8). In one exemplary embodiment, the second indicia segment 54 may be considered to be integral with the cylinder 50 of the second hinge member 42. It is understood that the indicia segments 52,54 could be separately attachable or removably connected to the respective cylinders 40,50. As shown in FIG. 8, for example, a slot could be provided in the cylinder (shown schematically) wherein the indicia segment could be slid into the slot and supported by the cylinder 50. Other connection configurations are also possible such as snap-fit arrangements, interference fit configurations, adjustable adhesives etc.

As further shown in FIGS. 2-8, the indicia member 14 defines a plurality of projections 56. For example, the individual letters of the indicia member define the projections 56. In addition, individual portions of the letters of the indicia member can also define the projections 56. The projections 56 are configured such that items can be hung therefrom as described in greater detail below. It is understood that the number of projections 56 can vary based on the design of the indicia member 14. The projections 56 may be considered hook members to support items hung thereon. Additional projections could be incorporated as part of the indicia member or could also be incorporated into the base 12 if desired. The projections 56 can also be formed or curved to further project outward from the base 12 or in certain other configurations to enhance use as a hanger member.

As can be appreciated from FIGS. 2-8, the base 12 may be fabricated in generally a single integral member. It is understood that the base 12 may also be connected together from separate members. The base 12 generally defines a periphery of the device 10. The indicia member 14 may also be connected to the cylinder 40 of the hinge member 32 and may be integral therewith in one exemplary embodiment of the invention (FIGS. 6-8). In this particular embodiment, the first indicia segment 52 is connected to or is integral with the first cylinder 40 (FIG. 7). The cylinder 40 is aligned with an upper spacer 41 as well as a lower spacer 41. The cylinder 40 and spacers 41 are aligned with the first support 34 and the second support 36. The rod 38 is inserted through the first support 34 as well as the upper spacer 41, cylinder 40, lower spacer 41 and is anchored in the second support 36. (See. E.g., FIG. 6.) With this connection, the indicia member 14 is pivotally connected to the base 12 and, in particular, the first indicia segment 52 is pivotally connected to the base 12 and will be described in greater detail below. The first hinge member 32 is positioned between the first upper member 16 and second lower member 18. Similarly, the second indicia segment 54 is connected to or is integral with the second cylinder 42 (FIG. 8). The cylinder 50 is aligned with an upper spacer 51 as well as a lower spacer 51. The cylinder 50 and spacers 51 are aligned with the first support 44 and the second support 46. The second rod 48 is inserted through the first support 44 as well as the upper spacer 51, cylinder 50, lower spacer 51 and is anchored in the second support 46. With this connection, the indicia member 14 is pivotally connected to the base 12 and, in particular, the second indicia segment 54 is pivotally connected to the base 12. The second hinge member 42 is positioned between the first upper member 16 and the second lower member 18. Thus connected, the hanger device 10 takes the form as generally shown in FIGS. 2 and 3 and is ready for connection to a mounting surface.

Figure 5:
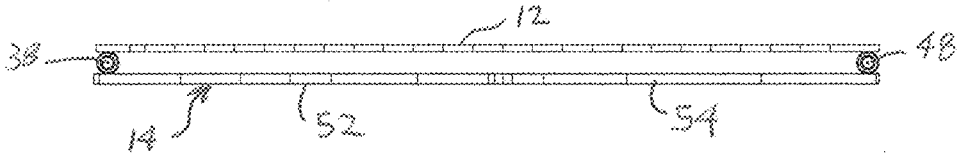
FIG. 5 is a top view of the hanger device shown in FIG. 1.
Figure 16:
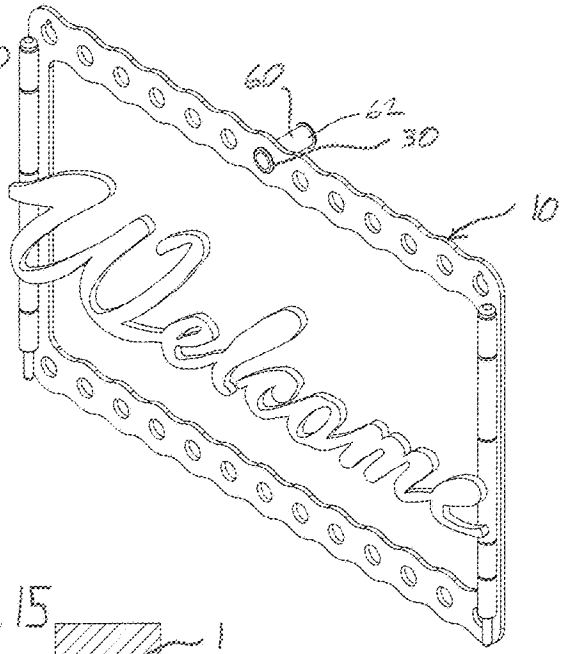
FIG. 16 is a partial perspective view of the hanger device mounted in the alternative configuration.
Figure 15:
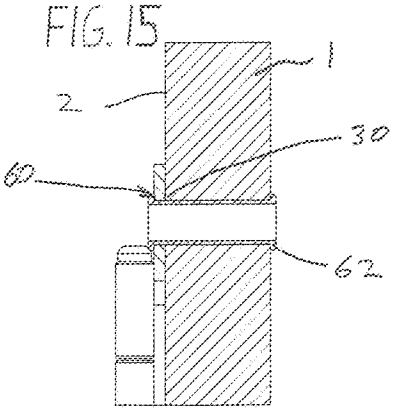
FIG. 15 is a partial cross-sectional view of the hanger device and door taken along line A-A of FIG. 14.
Figure 14:
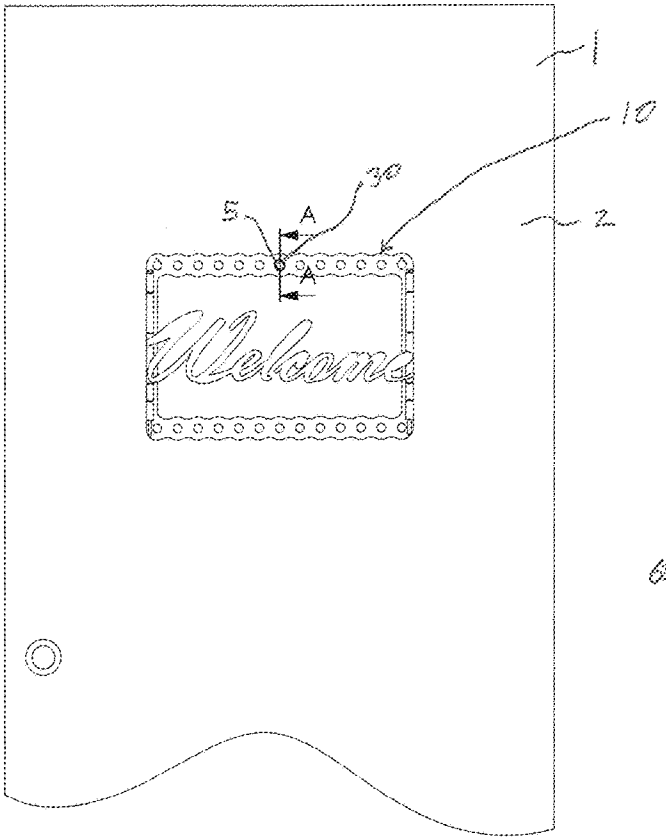
FIG. 14 is a front elevation view of the hanger device according to the present invention and mounted to a door in an alternative configuration.

As shown in FIG. 1, the hanger device 10 is configured to be mounted to a surface for use. In one exemplary embodiment, the mounting surface is an inside surface 2 of a door 1 that faces into a room of, for example, a residence or office. The hanger device 10 is capable of being mounted to the surface 2 of the door 1 in multiple configurations. In a first configuration, fasteners 4 are inserted through the end apertures 26 of the base 12 and into the door 1. In a second configuration, the central mounting aperture 30 of the base 12 cooperates with a door-viewer structure 5 of the door to mount the hanger device 10. This configuration will be described in greater detail below (FIGS. 14-16). It is understood that in the first configuration, the fasteners 4 could be inserted in any of the mounting apertures 24. In each configuration, the hanger device 10 is mounted generally flush with the door 1. As further shown in FIGS. 1-5, the indicia member 14, including the first indicia segment 52 and the second indicia segment 54, are generally coplanar with the base 12 (FIG. 5). In this first position, the letters of each of the first indicia segment 52 and the second indicia segment 54 collectively define the indicia displayed from the device 10, namely the word "Welcome." As further shown in FIGS. 1-3, respective distal ends of the first indicia segment 52 and the second indicia segment 54 confront one another when the indicia member 14 is in the first position to display the indicia, "Welcome." Thus, the first indicia segment 52 is positioned adjacent to the second indicia segment 54 wherein the respective sets of letters collectively define the indicia. The indicia member 14 is further generally within the periphery defined by the base 12.

Figure 9:
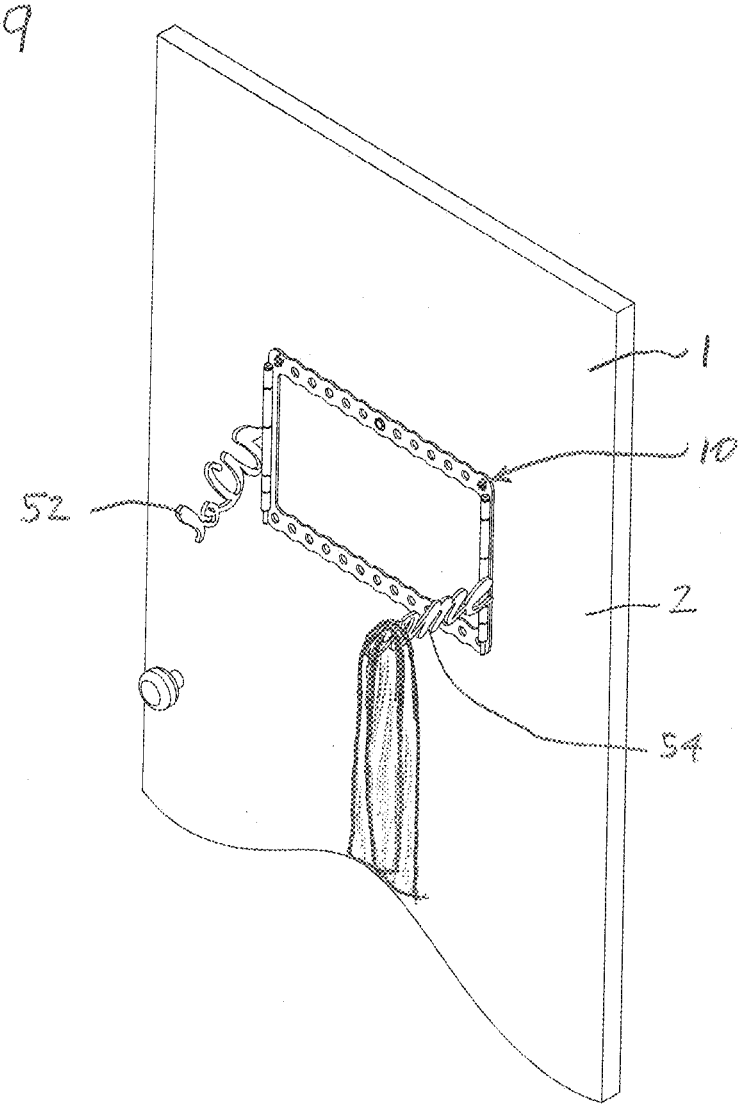
FIG. 9 is a perspective view of the hanger device according to the present invention mounted on a surface of a door wherein the hanger device has indicia members pivoted to an operable position, wherein an item of apparel is hung from one of the indicia members.
Figure 10:
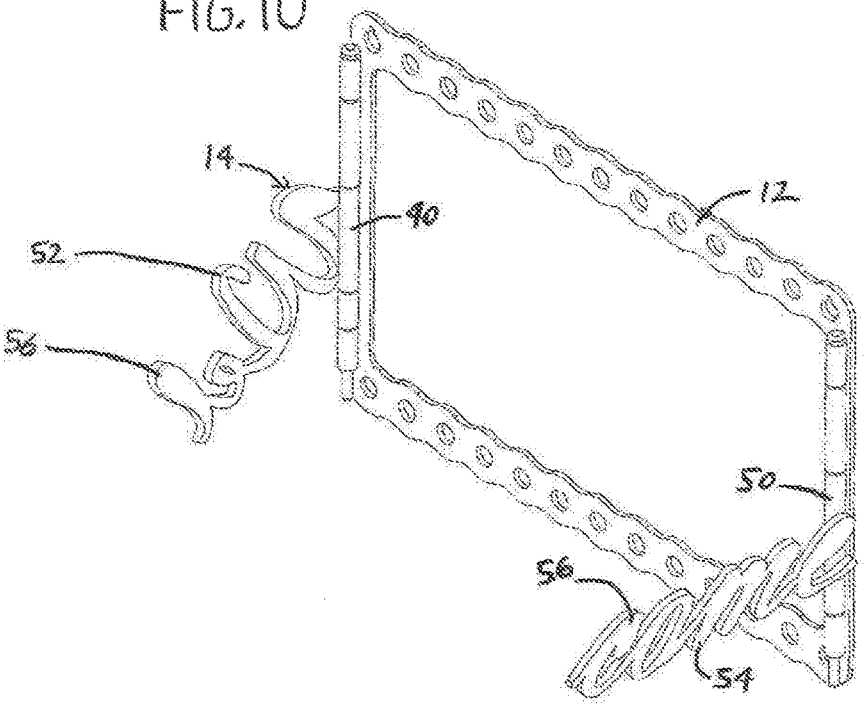
FIG. 10 is a perspective view of the hanger device having indicia members pivoted to an operable position.
Figure 11:
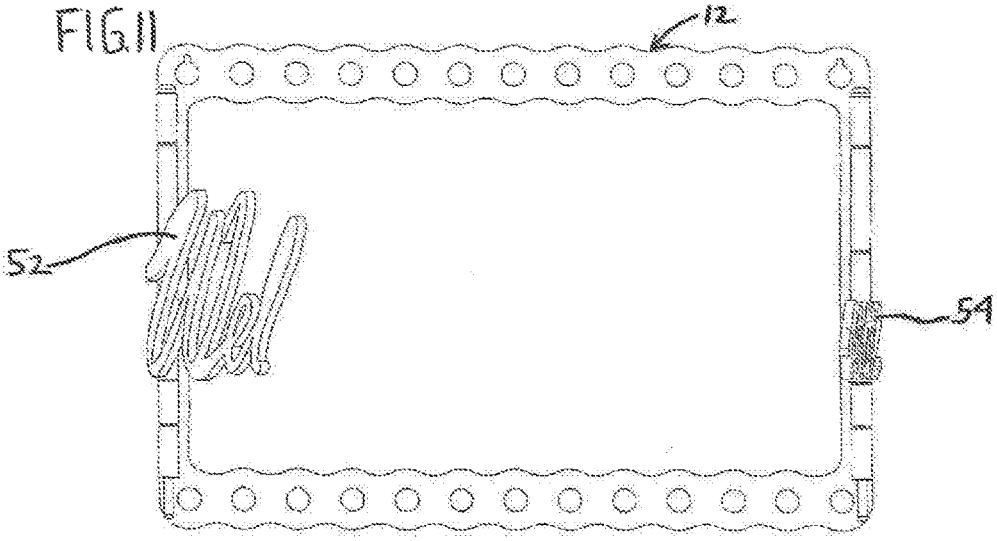
FIG. 11 is a front elevation view of the hanger device having indicia members pivoted to an operable position.
Figure 12:
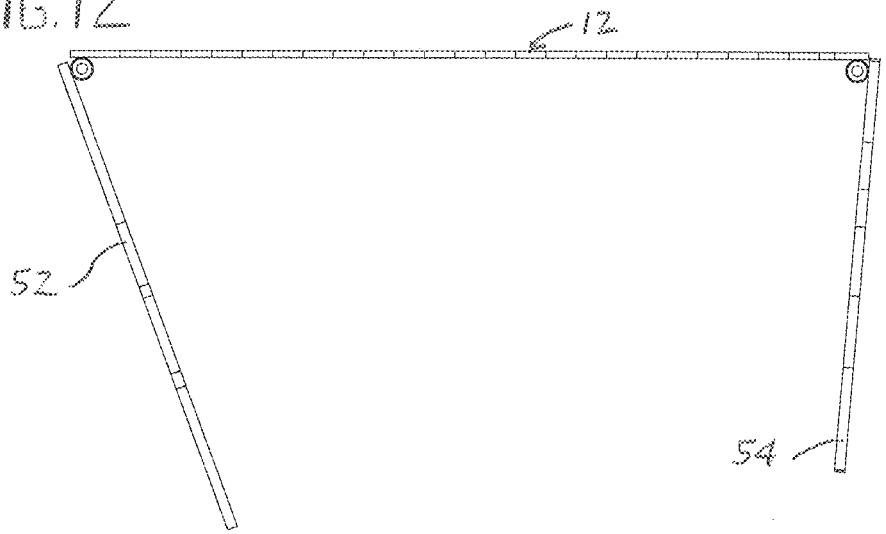
FIG. 12 is a top plan view of the hanger device having indicia members pivoted to an operable position.
Figure 13:
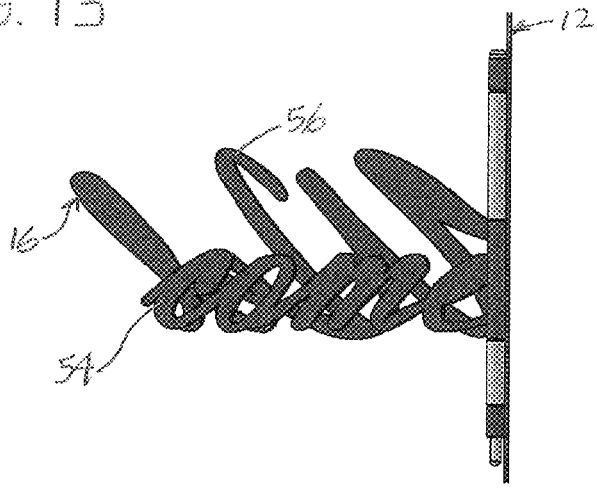
FIG. 13 is a side elevation view of the hanger device also having the indicia members pivoted to an operable position.

As shown in FIGS. 9-13, the indicia member 14 including the first indicia segment 52 and the second indicia segment 54 are capable of occupying a second position that is generally pivoted away from the base 12. The second position may be referred to as an operable position. In particular, the first hinge member 32 is rotatable about a vertical axis to pivot the first indicia member 52 away from the base 12. The first cylinder 40 rotates about a vertical axis around the rod 38. Similarly, the second hinge member 32 is rotatable about a vertical axis to pivot the second indicia member 54 away from the base 12. The second cylinder 50 rotates about a vertical axis around the rod 48. In this second position, the first indicia segment 52 and the second indicia segment 54 are no longer generally coplanar with the base 12 (FIG. 12) and project further into the room and away from the mounting surface 2 of the door 1 (FIG. 9). In this second position, the projections 56 are presented for use. As shown in FIG. 9, items can then be hung from the projections 56 of the indicia segments 52,54 of the indicia member 14. In an exemplary embodiment, the item(s) is hung directly on or directly from the indicia member 14. The items can take various forms such as apparel items including coats, jackets and sweaters. Accessory items such as purses and the like can also be hung from the projections 56. Accordingly, in the first position, the indicia is collectively defined and displayed by the member/segments from the device 10 (FIG. 1). In the second position, the indicia member 14 and segments 52,54 are positioned such that items can be hung directly from the member 14 and segments 52,54 in particular (FIG. 9). When it is no longer necessary to hang items from the device 10 such as if guests have left the residence, the indicia segments 52,54 can be rotated and pivoted back to the first position wherein the indicia is again displayed from the device 10. It is understood that the indicia segments 52,54 can be pivoted independently from one another and can be pivoted among a plurality of different angular positions with respect to the base 12. It is further understood that items could be capable of being hung from the projections 56 with the indicia segments 52,54 in the first position. Items, however, are more easily hung from the projections 56 with the indicia segments 52,54 are in the second position.

FIGS. 14-16 disclose the hanger device 10 hung on the surface 2 of the door 1 in the alternative, second configuration. In this configuration, the hanger device 10 cooperates with a door viewer structure 60 for mounting. FIG. 16 shows the mounting configuration with the door removed for clarity. The door viewer structure 60 includes a cylinder member 62 that includes internal structure for viewing through the door as is known in the art. The cylinder member 62 is fit within a channel formed in the door 1. As further shown in FIG. 15, the cylinder member 62 is positioned through the central mounting aperture 30 of the base 12. Similarly stated, the first upper member 16 of the base 12 is positioned around the door viewer structure 60. As the cylinder member 62 of the door viewer structure 60 is supported by the door 1, the base 12 of the hanger device is supported by the door viewer structure 60. A gap may exist between the surface 2 of the door 1 and a portion of the door viewer structure 60 wherein the first upper member 16 is positioned in the gap. It is understood that the door viewer structure 60 can be unscrewed or unfastened from the door 1 wherein the cylinder member 62 can be inserted through the central mounting aperture 30 and then the door viewer structure 60 can then be retightened on the door 1. In this configuration, the hanger device 10 is supported by the door viewer structure 60 wherein separate fasteners 4 are not necessary.

As explained above, in one exemplary embodiment, the hanger device 10 is attached to a mounting surface in the form of the surface 2 of the door 1. For example, the hanger device 10 may be mounted on an inside surface of a door in an apartment, condominium or townhouse where space may be limited. The mounting surface 1 could also take other forms including a wall in similar residences. Doors and walls in traditional homes or offices in commercial buildings and retail establishments are also possible.

The indicia member 14 in one exemplary embodiment is the word, "Welcome." It is further understood that the indicia member can be the same word in different languages. Accordingly, the word "Welcome" may be translated into other languages including but not limited to: Bienvenue, Welkom, Khosh Aamadid, Bonvenon, Weizo, Wilkommen, and Willkumm. Indicia in the form of other words is also possible. In addition, it is understood that the indicia member 14 and individual indicia segments can be further adjustable including height variations as well as utilizing different fonts. Other messages can also be conveyed by the indicia member 14 such as names, corporate logos, slogans etc.

Figure 17:
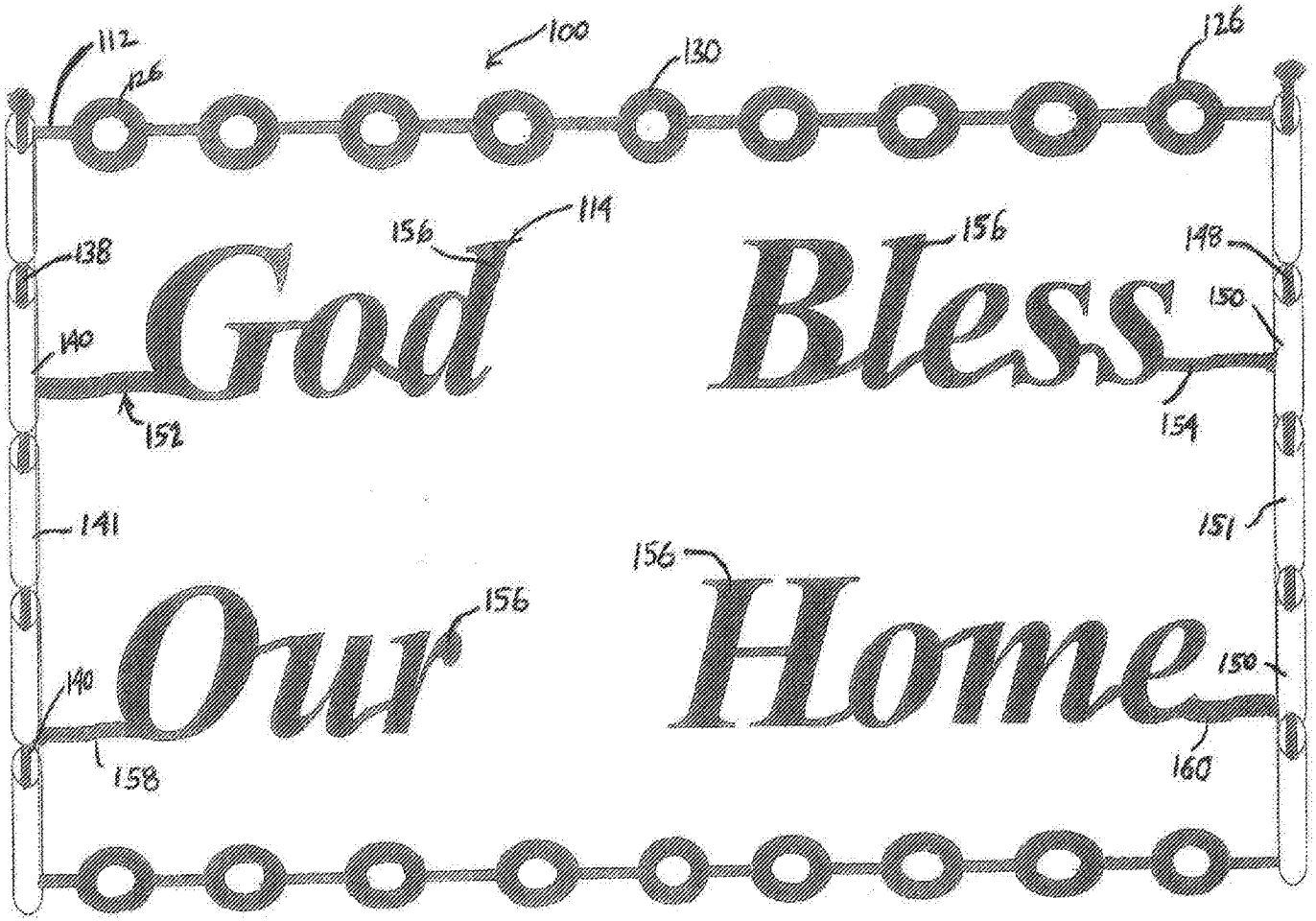
FIG. 17 is an alternative embodiment of the hanger device of the present invention.
Figure 18:
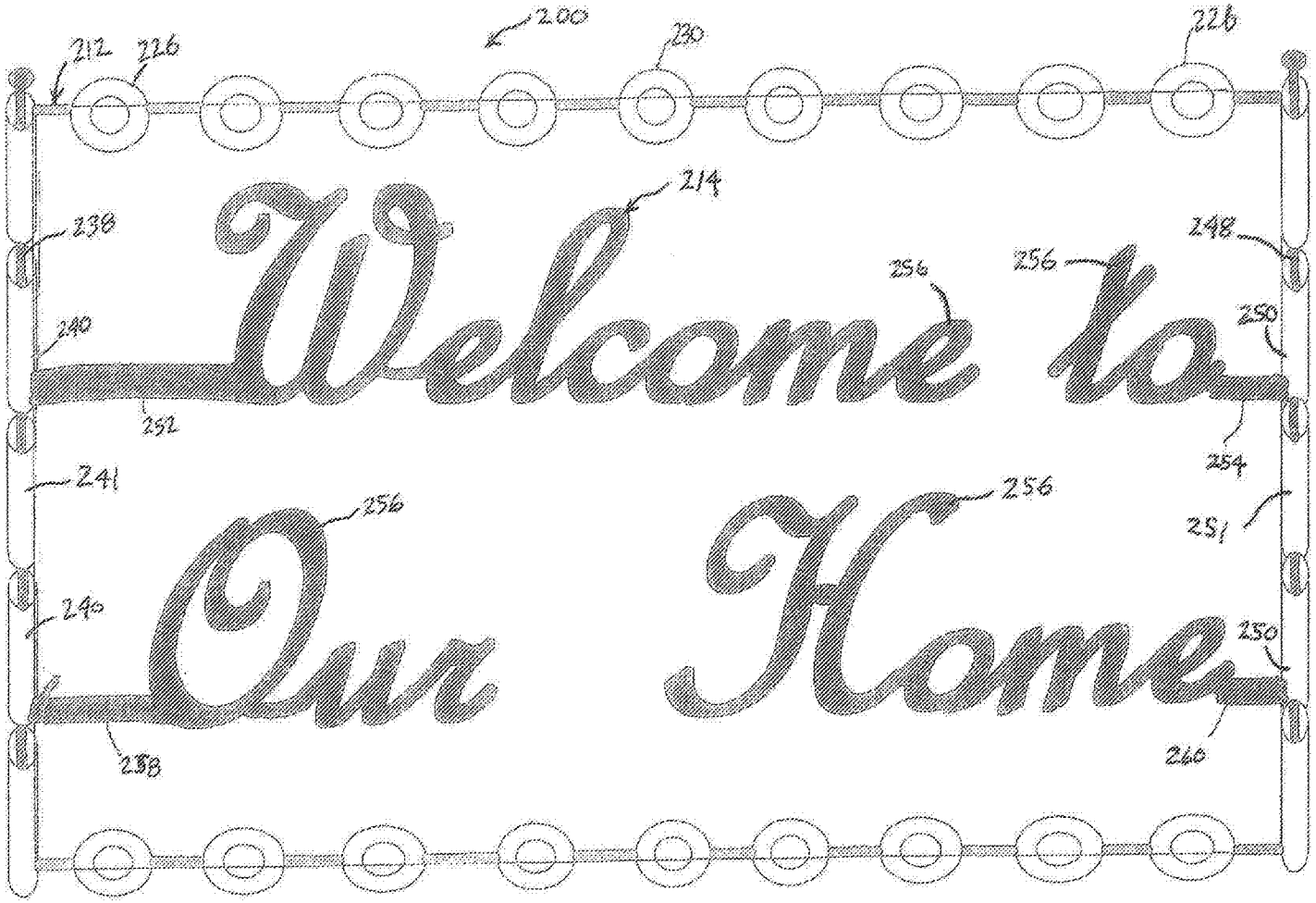
FIG. 18 is another alternative embodiment of the hanger device of the present invention.

FIGS. 17 and 18 disclose additional exemplary embodiments of hanger devices of the present invention. The hanger devices of these embodiments are similar to the hanger device 10 disclosed in FIGS. 1-13 and similar structures will be designated with similar reference numerals in a different reference number series. In these exemplary embodiments, the indicia utilized in the hanger device generally takes the form of a phrase.

Accordingly, FIG. 17 shows a hanger device, generally designated with the reference numeral 100. The hanger device 100 has a base 112 and an indicia member 114 pivotally connected to the base 112. Similar to the previous construction, the base 112 is generally a connected or integral rectangular member. The indicia member 14 has a plurality of indicia segments that collectively define the indicia that is in the form of a phrase, i.e., "God Bless Our Home." In this exemplary embodiment, each word of the indicia is comprised of a separate indicia segment. Thus, the indicia member 114 includes a first indicia segment 152, a second indicia segment 154, a third indicia segment 158 and a third indicia segment 160. Similar to the constructions above, the indicia segments 152,154,158,160 are pivotally connected to the base 112 wherein each segment is connected to a respective cylinder 140,150 that are rotatable about rods 138,148. Spacers 141,151 may also be used. The indicia segments 152,154,158,160 define a plurality of projections 156. The base 112 has end apertures 126 and a central mounting aperture 130 wherein the base 112 can be mounted to a mounting surface in multiple configurations as described above. The indicia segments 152,154,158,160 have a first position such as shown in FIG. 17 wherein the segments collectively define the indicia wherein the phrase is displayed. The indicia segments 152,154,158,160 are independently pivotable away from the base 112 in a second position wherein items can be hung from the segments 152,154,158,160 consistent with the description above.

FIG. 18 shows a hanger device, generally designated with the reference numeral 200. The hanger device 200 has a base 212 and an indicia member 214 pivotally connected to the base 212. Similar to the previous construction, the base 212 is generally a connected or integral rectangular member. The indicia member 214 has a plurality of indicia segments that collectively define the indicia that is in the form of a phrase, i.e., "Welcome to Our Home." In this exemplary embodiment, each word of the indicia is comprised of a separate indicia segment. Thus, the indicia member 214 includes a first indicia segment 252, a second indicia segment 254, a third indicia segment 258 and a third indicia segment 260. Similar to the constructions above, the indicia segments 252,254,258,260 are pivotally connected to the base 212 wherein each segment is connected to a respective cylinder 240,250 that are rotatable about rods 238,248. Spacers 241,251 may also be used. The indicia segments 252,254, 258,260 define a plurality of projections 256. The base 212 has end apertures 226 and a central mounting aperture 230 wherein the base 212 can be mounted to a mounting surface in multiple configurations as described above. The indicia segments 252,254,258,260 have a first position such as shown in FIG. 18 wherein the segments collectively define the indicia wherein the phrase is displayed. The indicia segments 252,254,258,260 are independently pivotable away from the base 212 in a second position wherein items can be hung from the segments 252,254,258,260 consistent with the description above.

Figure 19:
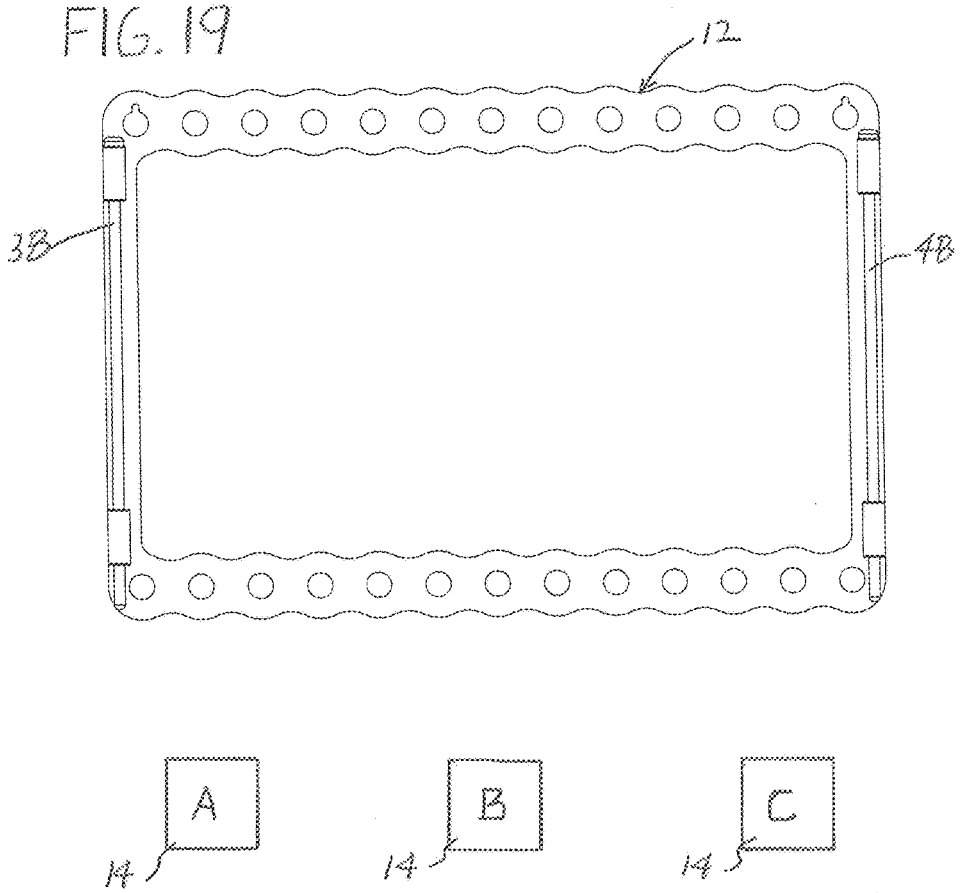
FIG. 19 is another alternative embodiment of the hanger device schematically depicting multiple sets of indicia members.

The hanger device 10 of the present invention further allows interchangeability of the indicia member 14 in the base 12. Thus, the indicia member 14 can take various forms including different words or phrases as discussed above. It is understood that the rod 38,48 can be removed from the hanger device 10 wherein a cylinder/indicia segment can be replaced with a different cylinder/indicia segment and the rod 38,48 reinserted as discussed above. Accordingly, a new set of indicia segments could be connected to the base to provide a second or new indicia for display that is different from the original indicia displayed. An indicia in the form of a word can be changed to a different word or to a phrase and vice versa. Other interchangeability structures can also be provided. For example, the indicia segment could be removably connected to the cylinder in various forms including via fasteners, snap-fit connections, slide-fit connections, or other types of connections. In this configuration, the cylinders can remain connected to the base via the rod. The indicia segments desired to display a particular indicia message can then be attached to the cylinders as desired. Accordingly, in one exemplary embodiment of the invention, the hanger device can take the form of a kit. The kit may generally include the base 12 and a plurality of sets of different indicia members 14. As shown in FIG. 19, the base 12 has the rods 38,48 that are supported in the support members or bushings. In this exemplary embodiment, the kit includes three different sets of indicia members 14: indicia member A, indicia member B and indicia member C. The indicia members 14 may include different indicia segments that convey different messages and further include the necessary spacer members etc. For example, indicia member A may include indicia segments for the message "Welcome." The indicia member B may include indicia segments that include the messages such as in FIGS. 17 and 18. Indicia member C may include segments that include the message "Merry Christmas" or other holiday greeting. Thus, a user can interchange the indicia members 14 at different times to convey different messages. It is understood that while three sets of indicia members are shown, the number of indicia members can be two or more sets of indicia members. In a further exemplary embodiment, the indicia member 14 can comprise a plurality of indicia segments wherein each indicia segment is an individual letter. Each letter has connection structures wherein the letters are capable of being attached to one another on a fore or aft portion of the letter. With sufficient multiple, identical letters, symbols, punctuation members etc. comprising the indicia member 14, the indicia member 14 can be customized to practically any desired message. The interconnected indicia member 14 can be connected to the cylinder(s) and base 12 as described herein. It is further understood that the indicia segments can be of various fonts, colors and styles etc.

The hanger device of the present invention provides several benefits. The hanger device can be mounted to a mounting surface in multiple configurations. The hanger device can further utilize existing structures such as a door-viewer structure for mounting which provides efficient mounting methods. The hanger device has a configuration to display indicia in the form of a message while easily being moved to another configuration wherein the indicia member can operably function as a hanger for hanging items thereon. These configurations save on space and efficiently use space in particular where space is limited such as in apartments or condominiums, offices, retail spaces etc. In addition, the indicia segments of the indicia member can be interchanged in the base to provide various messages as desired such as during holidays etc. The indicia segments of the indicia member 14 may also take the form of other messages including names, slogans and corporate logos etc.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A hanger device for hanging items of apparel thereon, the hanger device comprising:

a base configured to be mounted on a surface of a door;

an indicia member configurable as a display and configurable for hanging the items of apparel thereon, the indicia member comprising a first indicia segment having a proximal end pivotally connected to a first end of the base with a first hinge, and a second indicia segment having a proximal end pivotally connected to a second end of the base with a second hinge; the first indicia segment comprising a plurality of unitarily formed letters extending from the proximal end of the first indicia segment to a distal end; the second indicia segment comprising a plurality of unitarily formed letters extending from the proximal end of the second indicia segment to a distal end; the plurality of letters of the first indicia segment defining at least one projection, and the plurality of letters of the second indicia segment defining at least one projection; the first indicia segment and the second indicia segment each positionable in a first position wherein the first indicia segment and the second indicia segment are substantially coplanar with the base, and a second position wherein the first indicia segment and the second indicia segment are pivotally positioned away from the base such that the first indicia segment and the second indicia segment are non-coplanar with the base;

wherein when both the first indicia segment and the second indicia segment are in the first position, the distal end of each of the first indicia segment and the second indicia segment are aligned in a confronting position such that the plurality of letters of each of the first indicia segment and the second indicia segment collectively define one or more words to form the display, and wherein when the first indicia segment and the second indicia segment are in the second position, the items of apparel are capable of being hung on each of the at least one projection of the first indicia segment and the at least one projection of the second indicia segment.

2. The hanger device of claim 1, wherein the at least one projection of the first indicia segment comprises a plurality of projections defined by the plurality of letters of the first indicia segment, and the at least one projection of the second indicia segment comprises a plurality of projections defined by the plurality of letters of the second indicia segment, each of the plurality of projections capable of having the items of apparel hung thereon.

3. The hanger device of claim 1, wherein the first indicia segment and the second indicia segment are independently positionable in the first position and the second position.

4. The hanger device of claim 1, wherein the one or more words includes the word welcome.

5. The hanger device of claim 1, wherein the base has at least one member having at least one mounting aperture for mounting the base to the surface of the door.

6. The hanger device of claim 5, wherein the at least one mounting aperture is a plurality of mounting apertures.

7. The hanger device of claim 5, wherein the at least one mounting aperture includes a mounting aperture configurable in a first configuration and a second configuration, wherein in the first configuration the mounting aperture receives a fastener, and in the second configuration the mounting aperture is dimensioned to be positioned around and supported by a door-viewer structure of the door.

8. The hanger device of claim 1, wherein the base has a first member having at least one mounting aperture, and a second member having at least one mounting aperture, the first member and the second member each connected between the first end and the second end of the base.

9. The hanger device of claim 1, wherein each of the first hinge and the second hinge has a rod connected to the base and cylinder rotatable about the rod, the cylinder of the first hinge connected to the proximal end of the first indicia segment, and the cylinder of the second hinge connected to the proximal end of the second indicia segment.

10. The hanger device of claim 1, wherein the indicia member further comprises a third indicia segment having a proximal end pivotally connected to the first end of the base, and a fourth indicia segment having a proximal end pivotally connected to the second end of the base; the third indicia segment comprising a plurality of unitarily formed letters extending from the proximal end of the third indicia segment to a distal end; the fourth indicia segment comprising a plurality of unitarily formed letters extending from the proximal end of the fourth indicia segment to a distal end; the plurality of letters of the third indicia segment defining at least one projection, and the plurality of letters of the fourth indicia segment defining at least one projection; the third indicia segment and the fourth indicia segment each positionable in a first position wherein the third indicia segment and the fourth indicia segment are substantially coplanar with the base, and a second position wherein the third indicia segment and the fourth indicia segment are pivotally positioned away from the base such that the third indicia segment and the fourth indicia segment are non-coplanar with the base;

wherein when both the third indicia segment and the fourth indicia segment are in the first position, the distal end of each of the third indicia segment and the fourth indicia segment are aligned in a confronting position such that the plurality of letters of each of the third indicia segment and the fourth indicia segment collectively define more than one word to further form the display, and wherein when the third indicia segment and the fourth indicia segment are in the second position, the items of apparel are capable of being hung on each of the at least one projection of the third indicia segment and the at least one projection of the fourth indicia segment; and wherein when the first indicia segment, the second indicia segment, the third indicia segment, and the fourth indicia segment are positioned in the respective first position, the plurality of letters of the first indicia segment define a first word, the plurality of letters of the second indicia segment define a second word, the plurality of letters of third indicia segment define a third word, and the plurality of letters of the fourth indicia segment define a fourth word, such that the first word, the second word, the third word, and the fourth word collectively define a phrase.

* * * * *